US008662621B2

(12) United States Patent
Sawada

(10) Patent No.: US 8,662,621 B2
(45) Date of Patent: Mar. 4, 2014

(54) DROPLET JETTING APPLICATOR AND METHOD OF MANUFACTURING COATED BODY

(75) Inventor: Yasuhiko Sawada, Yokohama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 595 days.

(21) Appl. No.: 12/500,980

(22) Filed: Jul. 10, 2009

(65) Prior Publication Data

US 2010/0009065 A1 Jan. 14, 2010

(30) Foreign Application Priority Data

Jul. 14, 2008 (JP) ..... P2008-182555

(51) Int. Cl.
*B41J 29/393* (2006.01)

(52) U.S. Cl.
USPC ..... 347/19; 347/1; 347/23

(58) Field of Classification Search
USPC ..... 347/5, 9, 19, 1, 14, 23
See application file for complete search history.

(56) References Cited

U.S. PATENT DOCUMENTS

| | | | | |
|---|---|---|---|---|
| 6,802,580 | B2 * | 10/2004 | Valero | 347/1 |
| 6,905,186 | B2 * | 6/2005 | Kojima | 347/19 |
| 2004/0104951 | A1 * | 6/2004 | Shibata et al. | 347/14 |
| 2008/0024532 | A1 * | 1/2008 | Kim | 347/9 |

FOREIGN PATENT DOCUMENTS

| | | |
|---|---|---|
| JP | 2006-281116 | 10/2006 |
| JP | 2007-244960 | 9/2007 |
| JP | 2008-173800 | 7/2008 |

OTHER PUBLICATIONS

Japanese Office Action issued Aug. 21, 2012, in Japan Patent Application No. 2008-182555 (with Partial English translation).

* cited by examiner

*Primary Examiner* — Lam S Nguyen
(74) *Attorney, Agent, or Firm* — Oblon, Spivak, McClelland, Maier & Neustadt, L.L.P.

(57) ABSTRACT

A droplet jetting applicator includes a droplet jet head being movably provided, having a nozzle surface provided with multiple nozzles, and being configured to jet a liquid from the multiple nozzles as droplets, a cleaner configured to clean the nozzle surface, an image shooting unit configured to shoot shapes of the droplets jetted from the droplet jet head, and a controller configured to control the droplet jet head, the cleaner, and the image shooting unit and to detect the shapes of the droplets shot by the image shooting unit.

1 Claim, 3 Drawing Sheets

DROPLET JETTING APPLICATOR AND METHOD OF MANUFACTURING COATED BODY

CROSS REFERENCE TO RELATED APPLICATIONS

This application is based upon and claims the benefit of priority from prior Japanese Patent Application 2008-182555 filed on Jul. 14, 2008 the entire contents of which are incorporated by reference herein.

BACKGROUND OF THE INVENTION

1. Field of the Invention

The present invention relates to a droplet jetting applicator and a method of manufacturing a coated body.

2. Description of the Related Art

Usually, a droplet jetting applicator that jets droplets is used to manufacture various display devices including a liquid crystal display device, an organic electroluminescence (EL) display device, an electron emission display device, a plasma display device and an electrophoretic display device.

This droplet jetting applicator includes a droplet jet head (such as an ink jet head) configured to jet tiny droplets respectively out of multiple nozzles. By causing droplets to land on an object to be coated by using this droplet jet head, dot sequences are formed in a predetermined pattern. Note that the droplet jet head has a nozzle surface provided with the nozzles. The outer surface of a nozzle plate serves as this nozzle surface.

In a manufacturing process of a liquid crystal display device, for example, the droplet jetting applicator is used to sequentially apply R (red), G (green), and B (blue) color inks in dots onto a transparent substrate as a an object to be coated. Thereby, a color filter which is a coated body including different-color arrays of the dots thereon is manufactured. In addition, the droplet jetting applicator is also used to manufacture a frame of the color filter, i.e. a black matrix, and the like.

In the course of this manufacturing process, inks and foreign materials such as dust and dirt may be deposited around the nozzles on the nozzle surface. Formation of such deposits may cause a jetting failure such as displacement of landing positions of droplets or imperfect ink jets. In view of these problems, there has been disclosed a droplet jetting applicator configured to wipe a nozzle surface by pressing a cleaning roller onto the nozzle surface in order to remove deposits of inks and foreign materials such as dust and dirt from the nozzle surface. Meanwhile, there have also been disclosed other droplet jetting applicators such as one configured to dip a nozzle surface in a cleaning liquid, and then to wipe the nozzle surface by pressing a cleaning blade onto the nozzle surface.

However, the nozzle surface might also be damaged by these cleaning processes. Accordingly, as in the invention disclosed in Japanese Patent Application Publication No. 2007-244960, there has also been proposed a droplet jetting applicator configured to achieve a maximum cleaning effect while preventing damages on a nozzle surface.

BRIEF SUMMARY OF THE INVENTION

The invention disclosed in Japanese Patent Application Publication No. 2007-244960 makes it possible to clean the nozzle surface clearly without causing damages thereon, but may incur the following situations.

Specifically, in the method of cleaning a nozzle surface of a droplet jet head disclosed in Japanese Patent Application Publication No. 2007-244960, the nozzle surface is cleaned by pressing the nozzle surface onto a wiping section to absorb an ink deposited on the nozzle surface and a cleaning liquid used for cleaning and then to wipe off the ink and the cleaning liquid. This wiping section is made of a fibrous material such as lint.

In the meantime, due to the structure of the droplet jet head, the nozzles for jetting droplets cannot be formed integrally with parts surrounding the nozzles. Accordingly, the droplet jet head is formed as a combination of multiple members. Moreover, heads of screws for fixing the droplet jet head are located slightly recessed from the same plane as the nozzle surface. Normally, the heads of screws located as above cause no problem. However, if there is a burr protruding out of this plane, this burr might catch the fibers of the wiping section on which the nozzle surface is pressed at the time of cleaning.

Moreover, it's not impossible that the substrate as the object on which droplets are to be jetted includes a foreign material, and thus that the foreign material is deposited onto the nozzle surface when the droplet jet head is moved on the substrate in order to jet the droplets.

The present invention has been made to solve these problems. It is an object of the present invention to provide a droplet jetting applicator and a method of manufacturing a coated body, which are capable of detecting a deposit attached to a nozzle easily and reliably without changing a previously employed configuration by means of causing a droplet jet head to scan a region after jetting droplets without jetting additional droplets and detecting presence of a deposit attached to a nozzle based on changes in the shapes of the droplets thereafter.

A first aspect according to an embodiment of the present invention provides a droplet jetting applicator which includes: a droplet jet head being movably provided and having a nozzle surface provided with a plurality of nozzles, the droplet jet head being configured to jet a liquid as droplets respectively from the plurality of nozzles; a cleaner configured to clean the nozzle surface; an image shooting unit configured to shoot shapes of the droplets jetted by the droplet jet head; and a controller configured to control the droplet jet head, the cleaner and the image shooting unit, and to detect the shapes of the droplets shot by the image shooting unit.

A second aspect according to the embodiment of the present invention provides a method of manufacturing a coated body which includes a coating process having the steps of jetting droplets from a plurality of nozzles provided to a nozzle surface of a droplet jet head onto a check region provided on a substrate while moving the droplet jet head being movably provided and configured to jet a liquid as the droplets respectively from the plurality of nozzles; causing the droplet jet head to scan the check region on which the droplets are jetted without jetting additional droplets; shooting the check region by using an image shooting unit; and detecting shapes of the droplets shot by the image shooting unit and comparing the shapes of the droplets with normal shapes of droplets which are stored in advance.

BRIEF DESCRIPTION OF THE SEVERAL DRAWINGS

DETAILED DESCRIPTION OF THE INVENTION

An embodiment of the present invention will be described below in detail with reference to the accompanying drawings.

Figure 1:
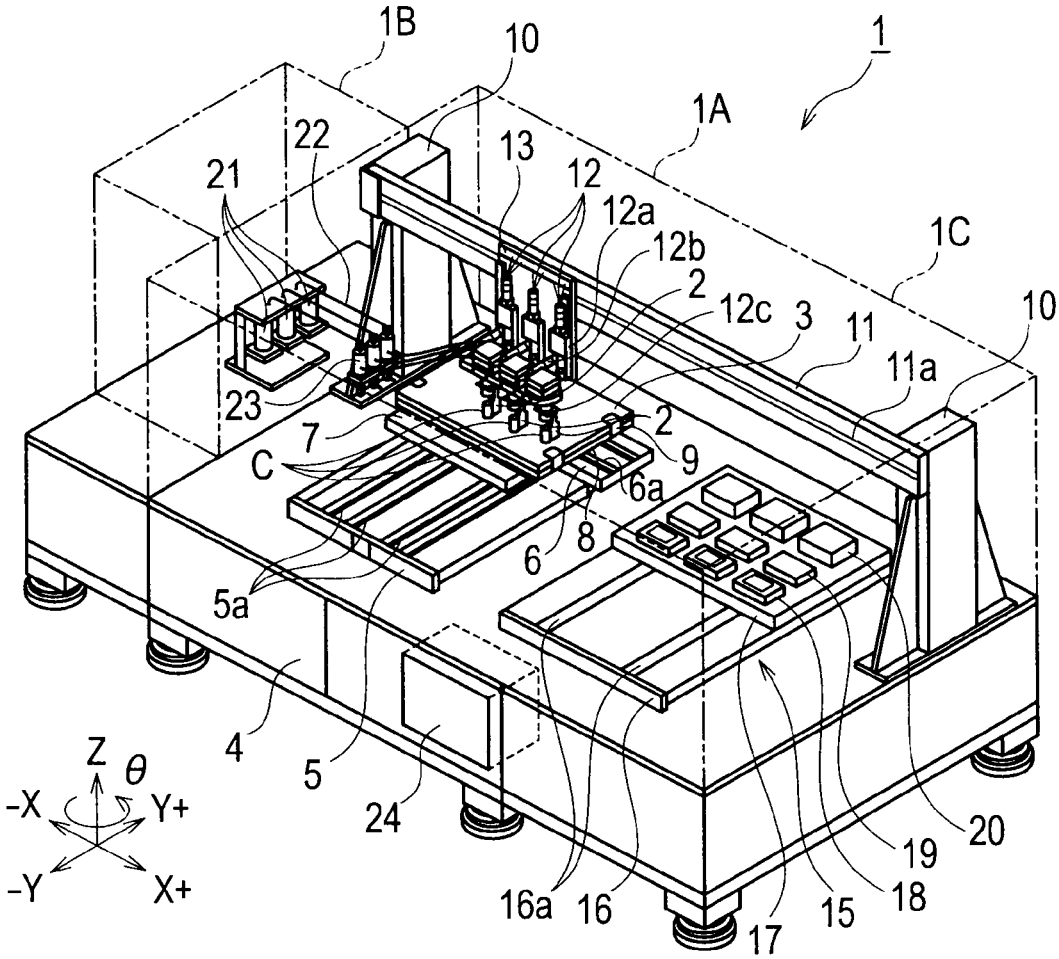
FIG. 1 is a perspective view showing an overall configuration of a droplet jetting applicator according to an embodiment of the present invention.

As shown in FIG. 1, a droplet jetting applicator 1 according to an embodiment of the present invention includes an ink coating box 1A and an ink supply box 1B. The ink coating box 1A coats an ink on a substrate 3 by using a droplet jet head 2 configured to jet an ink which is a liquid out of nozzles (not shown) as droplets. The ink supply box 1B supplies the ink to the ink coating box 1A. The ink coating box 1A and the ink supply box 1B are disposed adjacently to each other and are fixed to an upper surface of a mount 4.

A Y-axis direction sliding plate 5, a Y-axis direction moving table 6, an X-axis direction moving table 7, and a substrate holding table 8 are stacked inside the ink coating box 1A. The Y-axis direction sliding plate 5, the Y-axis direction moving table 6, the X-axis direction moving table 7, and the substrate holding table 8 are formed into plate shapes.

The Y-axis direction sliding plate 5 is fixed to the upper surface of the mount 4. Multiple guide grooves 5*a* are formed along a Y-axis direction on an upper surface of the Y-axis direction sliding plate 5. Guide protrusions (not shown) that are provided on a lower surface of the Y-axis direction moving table 6 are fitted into these guide grooves 5*a*. In this way, the Y-axis direction moving table 6 is provided on the upper surface of the Y-axis direction sliding plate 5 so as to be movable along the Y-axis direction. This Y-axis direction moving table 6 moves in the Y-axis direction along the respective guide grooves 5*a* by means of a driving mechanism using a Y-axis direction moving motor.

Multiple guide grooves 6*a* are formed along an X-axis direction on an upper surface of the Y-axis direction moving table 6. Guide protrusions (not shown) that are provided on a lower surface of the X-axis direction moving table 7 are fitted into these guide grooves 6*a*. In this way, the X-axis direction moving table 7 is provided on the upper surface of the Y-axis direction moving table 6 so as to be movable along the X-axis direction. This X-axis direction moving table 7 moves in the X-axis direction along the respective guide grooves 6*a* by means of a driving mechanism using an X-axis direction moving motor.

The substrate holding table 8 configured to hold the substrate 3 is fixed to an upper surface of the X-axis direction moving table 7. This substrate holding table 8 includes a substrate gripping mechanism 9 configured to grip the substrate 3. The substrate 3 is closely fixed onto the substrate holding table 8 by the substrate gripping mechanism 9. A clamp having one of four edges formed into an open end is used as the substrate gripping mechanism 9, for example. Here, as the means for holding the substrate 3, it is also possible to provide a substrate suction mechanism for suctioning the substrate 3, for example, instead of the substrate gripping mechanism 9. The substrate suction mechanism may apply a rubber sucker or a suction pump, for example.

Here, an amount of movement of the substrate holding table 8 in the Y-axis direction is detected based on a pulse signal (a position signal) of a Y-axis direction encoder. Similarly, an amount of movement of the substrate holding table 8 in the X-axis direction is detected based on a pulse signal (a position signal) of an X-axis direction encoder.

A pair of columns (pillars) 10 are vertically provided inside the ink coating box 1A. These columns 10 are provided in positions to interpose the Y-axis direction sliding plate 5 in a perpendicular direction to the guide grooves 5*a* on the Y-axis direction sliding plate 5, i.e. in the X-axis direction.

An X-axis direction sliding plate 11 is laid between the pair of columns 10. A guide groove 11*a* is provided along the X-axis direction on a front surface of the X-axis direction sliding plate 11. A guide protrusion (not shown), which is provided on a rear surface of a base plate 13 including multiple inkjet head units 12, is fitted into this guide groove 11*a*. In this way, the base plate 13 is provided on the X-axis direction sliding plate 11 so as to be movable in the X-axis direction. This base plate 13, i.e. the inkjet head units 12 move in the X-axis direction along the guide groove 11*a* by means of a driving mechanism using a head unit moving motor.

Each of the inkjet head units 12 is provided perpendicularly to the base plate 13 and includes a droplet jet head 2. These droplet jet heads 2 are detachably provided on tip ends of the respective inkjet head units 12. Each droplet jet head 2 includes a nozzle surface provided with multiple nozzles (through holes) for jetting droplets. This nozzle surface defines an outer surface of a nozzle plate. Here, a water-repellent film (not shown) for preventing deposition of inks and the like is provided on the nozzle surface.

Moreover, each of the droplet jet heads 2 is provided with a camera C that serves as an image shooting unit. The camera C shoots an image of a state of droplets landing on the substrate 3 and provides a shot image for checking a state of ejection of droplets from each droplet jet head 2.

Each of the ink jet head units 12 includes a Z-axis direction moving mechanism 12*a* configured to move the droplet jet head 2 and the camera C in a perpendicular direction relative to the surface of the substrate 3, i.e. in a Z-axis direction, a Y-axis direction moving mechanism 12*b* configured to move the droplet jet head 2 in the Y-axis direction, and a θ-direction rotating mechanism 12*c* configured to rotate the droplet jet head 2 in a θ-direction. Accordingly, the droplet jet heads 2 and the cameras C are rendered movable in the Z-axis direction as well as the Y-axis direction and rotatable in the θ-direction.

Meanwhile, a cleaner 15 configured to clean the droplet jet heads 2 of the respective inkjet head units 12 is provided inside the ink coating box 1A. This cleaner 15 is located in a position along the line extending in the moving direction of the inkjet head units 12 and away from the Y-axis direction sliding plate 5. When the droplet jet heads 2 of the respective inkjet head units 12 move to standby positions which are positions opposed to the cleaner 15, the cleaner 15 automatically cleans the respective droplet jet heads 2.

The cleaner 15 includes a Y-axis direction sliding plate 16, a Y-axis direction moving table 17 that is movably provided on the Y-axis direction sliding table 16, and multiple receivers 18 respectively provided on the Y-axis direction moving table 17. Similarly, the cleaner 15 further includes multiple washers 19 respectively provided on the Y-axis direction moving table 17 and multiple wipers 20 respectively provided on the Y-axis direction moving table 17.

The Y-axis direction sliding plate 16 is fixed onto the upper surface of the mount 4. Multiple guide grooves 16*a* are provided along the Y-axis direction on an upper surface of the Y-axis direction sliding plate 16. Guide protrusions (not shown) that are provided on a lower surface of the Y-axis direction moving table 17 are fitted into these guide grooves 16*a*. In this way, the Y-axis direction moving table 17 is provided on the upper surface of the Y-axis direction sliding plate 16 so as to be movable along the Y-axis direction. This Y-axis direction moving table 17 moves in the Y-axis direction along the respective guide grooves 16*a* by means of a driving mechanism using a Y-axis direction moving motor.

The receivers 18, the washers 19, and the wipers 20 are arranged in the direction of the respective guide grooves 16*a*, i.e. in the Y-axis direction. Moreover, these sets of the components are provided in the same number as the number of the inkjet head units 12, or namely the droplet jet heads 2. Moreover, the respective receivers 18 are arranged in the moving direction of the inkjet head units 12, i.e. in the X-axis direction. Similarly, the respective washers 19 are arranged in the X-axis direction and the respective wipers 20 are arranged in the X-axis direction.

Each receiver 18 receives an ink which is discharged and spilled out of a nozzle on the droplet jet head 2. A saucer is used as the receiver 18, for example. Meanwhile, each washer 19 washes the nozzle surface of the droplet jet head 2 by using a cleaning liquid. For example, a supply device configured to jet and to supply the cleaning liquid onto the nozzle surface of the droplet jet heat 2, a washer plate configured to hold the cleaning liquid into which the nozzle surface of the droplet jet head 2 is dipped, and the like are used for this washer 19. Each wiper 20 is made of an unillustrated fibrous body and is configured to absorb the ink and the cleaning liquid attached to the nozzle surface by pressing the droplet jet head 2 onto the wiper 20 and to wipe off the ink and the cleaning liquid which are not absorbed.

Meanwhile, as shown in FIG. 1, multiple ink tanks 21 for containing inks are provided inside the ink supply box 1B. These ink tanks 21 are respectively connected to the droplet jet heads 2 by way of corresponding supply pipes 22. Moreover, an ink buffer tank 23 is provided in the middle of each of the supply pipes 22.

Each ink buffer tank 23 adjusts a meniscus (a fluid level) of the ink on the tip of the nozzle by utilizing a water head difference (a water load) between a fluid level of the ink contained therein and the nozzle surface of the droplet jet head 2. In this way, a leakage or an ejection failure of the ink is prevented.

The droplet jet head 2 receives supply of the ink from the ink tank 21 through the ink buffer tank 23. The type of inks including a water-based ink, an oil-based ink, an ultraviolet curable ink, and the like are used as the ink herein. For example, an oil-based ink is made of various components including pigments, solvents (ink solutions), dispersants, additives, surfactants, and so forth. Here, grain sizes of the pigments ranges from 70 nm to 160 nm, for example. In particular, when the pigments are made of carbon black, the grain sizes thereof are set to 100 nm, for example.

A controller 24 for controlling the units of the droplet jetting applicator 1 and a storage (not shown) for storing various programs are provided inside the mount 4. The controller 24 controls the inkjet head units 12 and performs ejection of the droplets from the droplet jet heads 2 onto the substrate 3. Moreover, the controller 24 controls image shooting of the droplets applied on the substrate 3 as a result of this ejection by using the cameras C.

Further, the controller 24 performs motion control of the Y-axis direction moving table 6, motion control of the X-axis direction moving table 7, motion control of the base plate 13, drive control of the Z-axis direction moving mechanism 12*a*, drive control of the Y-axis direction moving mechanism 12*b*, drive control of the θ-direction rotating mechanism 12*c* and so forth based on various programs. In this way, it is possible to change relative positions between the substrate 3 held by the substrate holding table 8 and the ink jet head units 12 that are vertically provided on the base plate 13. In addition, the controller 24 performs motion control of the Y-axis direction moving table 17 of the cleaner 15, drive control of the washers 19 and the wipers 20, and the like based on various programs.

Next, a flow before a process for applying the ink (hereinafter the process will be also referred to as coating process) on the substrate 3 by using the inkjet head units 12 will be described. Roughly speaking, a preparation process for coating takes place prior to a coating process when the ink is applied on the substrate 3. Here, this preparation process for coating will be described.

Figure 2:
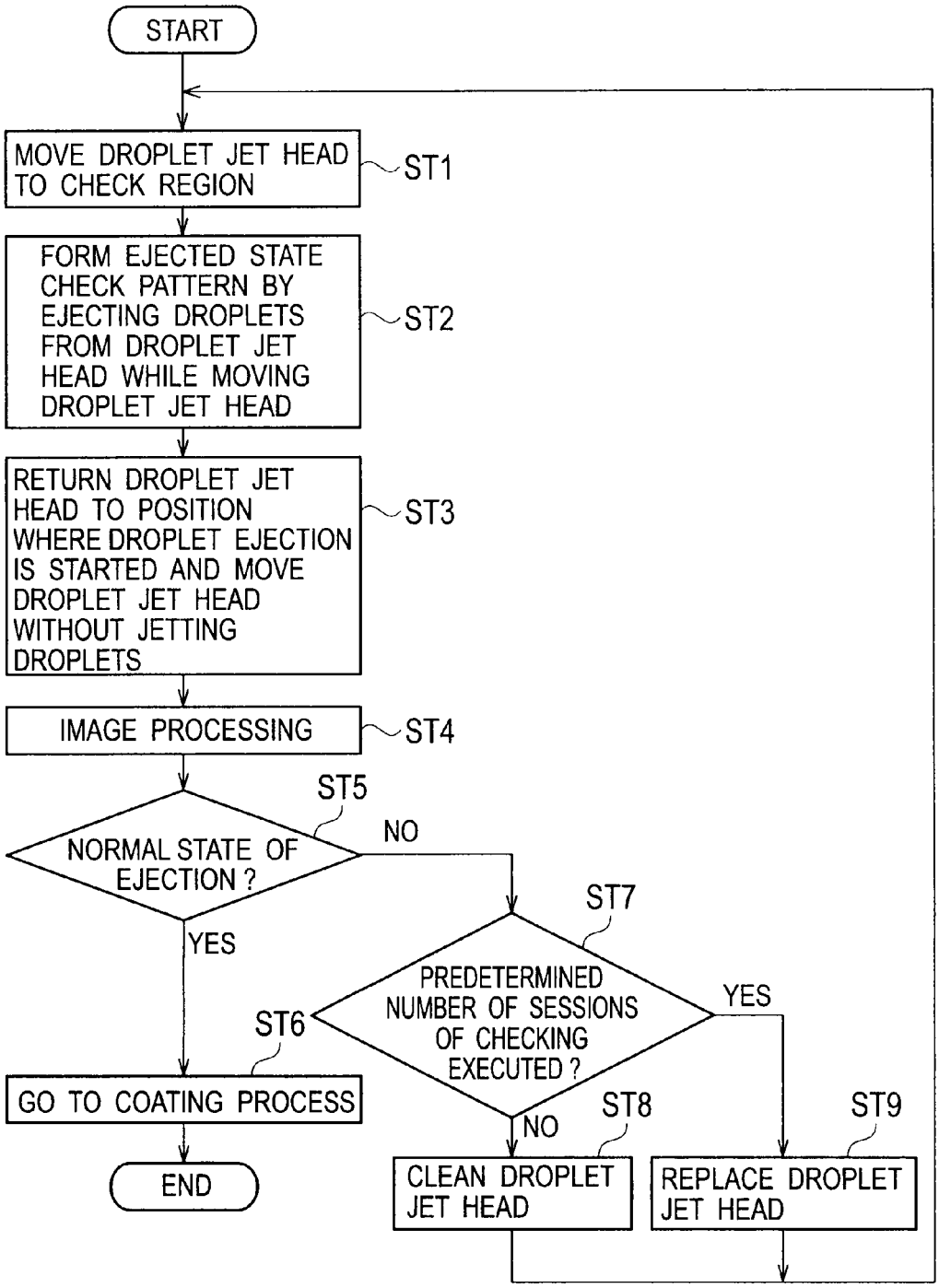
FIG. 2 is a flowchart showing an operational flow of checking a coated state in the embodiment of the present invention.

FIG. 2 is a flowchart showing a flow of the preparation process for coating. First, the substrate 3 is closely fixed onto the substrate holding table 8 by gripping the substrate 3 onto the substrate holding table 8 by use of the substrate gripping mechanism 9. This substrate 3 is provided with a region subjected to ejection of the ink from the droplet jet heads 2 and functioning as a color filter (such a region will be hereinafter referred to as a "functional region" for convenience), for example, and a check region (hereinafter referred to as a "check region A") used for checking whether or not the ink is properly ejected from the droplet jet heads 2 before applying the ink on this functional region. It is possible to freely design the numbers as well as layouts of the functional regions and the check regions A to be provided on the substrate 3.

When the substrate 3 is fixed to the substrate holding table 8, the inkjet units 12 are located in a position facing the surface of the substrate 3 provided with the functional regions and the check regions A. Accordingly, the inkjet units 12 (the droplet jet heads 2) move onto the check region A based on an instruction from the controller 24 in order to perform preparation for coating (ST1). The size of this check region A may be set into various sizes depending on a relation with the functional region on the substrate 3. Here, the check region A is formed into a 5-mm square shape, for example.

The inkjet head units 12 that move onto the check region A eject droplets from the droplet jet heads 2 toward this check region A. This ejecting operation is not executed just once but the operations are executed several times while moving the droplet jet heads 2 over the check region A. In this way, a pattern for checking how the droplets are applied on the substrate 3 in the case of ejecting the droplets from the droplet jet heads 2 is formed on the substrate 3 (ST2).

Figure 3:
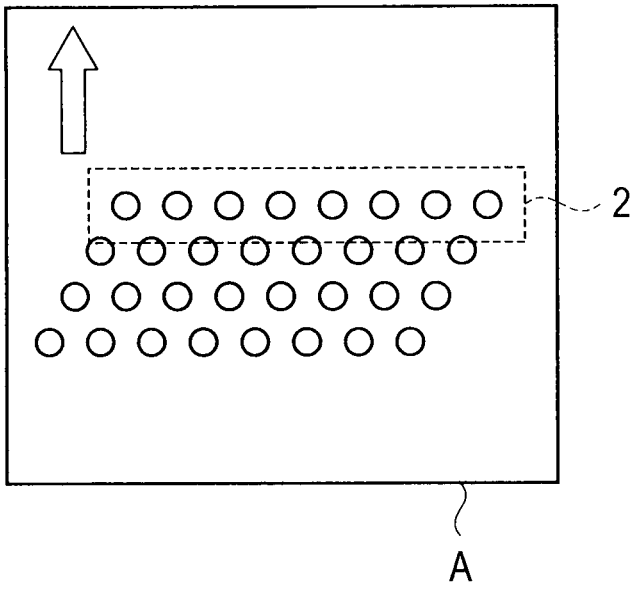
FIG. 3 is a schematic diagram showing a state of ejecting droplets in a check region.

FIG. 3 is a schematic diagram showing an ejected state check pattern which is formed on the check region A by ejecting the droplets from the droplet jet heads 2. The droplet jet heads 2 move over the check region A under the control of the controller 24 by way of moving the check region A in a direction indicated with an arrow shown in FIG. 3, for example, and eject the droplets at a predetermined pitch. However, if the droplets are ejected from the mutually adjacent droplet jet heads 2 at the same time, the droplets that land on the check region A may be connected to each other. Accordingly, when actually ejecting the droplets, the droplets are jetted onto the check region A only from multiple droplet jet heads 2 that are not adjacent to each other. FIG. 3 shows a state in which eight droplets in a horizontal array are ejected from the droplet jet heads 2 and four arrays are formed as a consequence. In FIG. 3, the droplet jet heads 2 are expressed as a rectangle in a broken line.

After forming the ejected state check pattern, the droplet jet heads 2 are returned to a position where ejection of the droplets onto the check region A is started. Then, again, the droplet jet heads 2 are caused to scan above the check region A, that is, above the droplets that were ejected from the droplet jet heads 2 and applied on the substrate 3 (the check region A) (ST3). At this time, no droplets are ejected from the droplet jet heads 2. Note that the above-described operation to cause the droplet jet heads 2 to scan the substrate 3 without ejecting the droplets will be hereinafter referred to as "idle running" for convenience.

After applying the droplets on the substrate 3 (and before applying droplets on another substrate 3), the nozzle surfaces of the droplet jet heads 2 are cleaned by use of the cleaner 15. This cleaning process is achieved by means of absorption using the fibrous body or by wiping off the nozzle surfaces as described previously. When the nozzle surfaces are cleaned with this fibrous body, fibrous dust such as lint constituting the fibrous body might be attached to the nozzle surfaces because a screw head or a burr protruding out of any of the nozzle surfaces may catch the fibers of the fibrous body at the time of cleaning the nozzle surfaces. Moreover, there is also a possibility that foreign materials such as dust or dirt may be located on the substrate subjected to droplet ejection and that these foreign materials may be attached to the nozzle surfaces when moving the droplet jet heads over the substrate in order to jet the droplets (the fibrous dust and the foreign materials to be attached to the nozzle surfaces will be hereinafter collectively referred to as "deposits").

Figure 4:
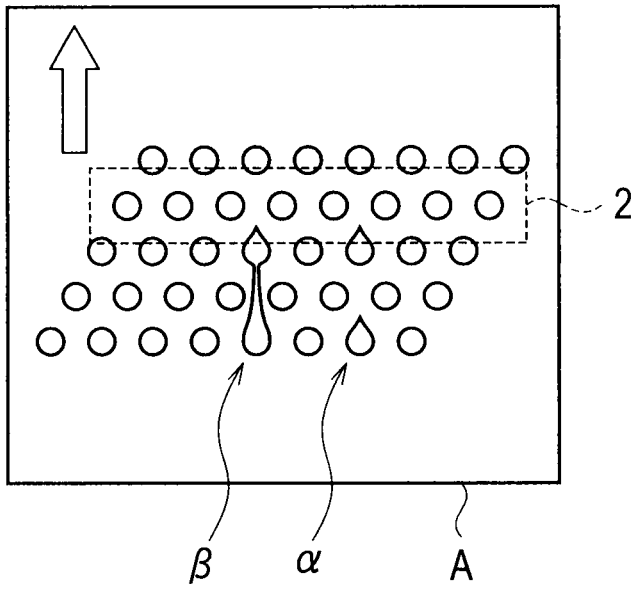
FIG. 4 is a schematic diagram showing a state of causing the droplet jet head to run idly over the droplets ejected in the check region.

If the droplet jet heads 2 move over the applied droplets while attaching the deposits onto the nozzle surfaces, the applied droplets may be scratched by the deposits. FIG. 4 illustrates such a condition. Accordingly, as described previously, after the droplets are jetted on the check region A (see FIG. 3), the droplet jet heads 2 are caused to run idly over the droplets in a direction indicated with an arrow in FIG. 4, for example.

When no deposits are attached to the nozzle surfaces, the droplets applied on the substrate 3 are not scratched when the droplet jet heads 2 run idly over the check region A, so that the droplets remain on the substrate 3 in the originally applied shapes.

On the other hand, if a deposit is attached to the nozzle surfaces, a foreign material contacts an upper part of any of the applied droplets. Therefore, the droplet is scratched in the direction of idle running of the droplet jet heads as indicated with reference code α in FIG. 4. Otherwise, as indicated with reference code β in FIG. 4, the droplet may be scratched more significantly than the state indicated with the reference code α and may be connected to any other adjacent or surrounding droplets, for example.

In other words, the droplet which is properly ejected onto the substrate 3 has a substantially circular shape when viewed from the position of the droplet jet head 2 (the camera C). Accordingly, after idle running of the droplet jet head 2, it is possible to confirm whether or not any deposits are attached to the nozzle surfaces by shooting images with the cameras C and checking whether or not the droplets have the substantially circular shape.

Specifically, the droplet jet head 2 is caused to run idly over the droplet applied on the substrate 3 and the state of the droplet after it is applied is shot by use of the camera C serving as the image shooting unit. Then, the preset shape of the droplet (which is the substantially circular shape) is compared with the actual shape of the droplet after idle running. For example, circularity of the shape of the droplet after idle running is measured based on circularity possessed by the preset shape of the droplet. Note that the entire process described above is expressed together with image processing in the flowchart shown in FIG. 2 (ST4).

By performing this comparison, it is possible to confirm whether or not the state of ejection from the droplet jet heads 2 onto the substrate 3 is normal, i.e. whether or not the droplets are properly jetted (the sizes and shapes of the droplets) out of the through holes provided on the nozzle surfaces and whether or not any foreign materials are attached to the nozzle surfaces (the shapes of the droplets) (ST5). When the ejection from the droplet jet heads 2 is determined to be normal (YES in ST5), the coating process is executed to perform ejection on the functional regions provided on the substrate 3 (ST6).

On the other hand, if the shapes of the droplets after idle running of the droplet jet heads 2 are different from the preset shape as a result of the image processing conducted by the controller 24, then the state of ejection onto the substrate 3 is determined to be not normal (NO in ST5). This result shows the condition of any of the droplet jet heads 2 that the droplet is not properly ejected from the nozzle for some reason or that there is a deposit on the nozzle surface.

Thereafter, a judgment is made as to whether or not a predetermined number of sessions of ejection in the check region A are executed (ST7). This judgment is executed to establish a basis of determination for cleaning (ST8) or replacing (ST9) the droplet jet heads 2. When the deposits are removed from the nozzle surfaces by cleaning the nozzle surface with the cleaner 15, the droplet jet heads 2 can eject the droplets properly in the check region A and the droplets are not scratched by idle running of the droplet jet heads 2 after ejection. Hence the checking operation including droplet ejection, idle running, and cleaning is repeated for the predetermined number of sessions. Note that the number of sessions can be arbitrarily determined.

When the number of sessions turns out to be below the predetermined number (NO in ST7) as a result of judging whether or not the predetermined number of sessions of the checking operation have been completed, the droplet jet heads 2 are cleaned by using the cleaner 15 (ST8) and then the operation including droplet ejection and idle running is repeated while moving the droplet jet heads 2 to a different check region A (ST1 to ST4). As a consequence, the coating process is executed (ST6) when the state of ejection is determined to be normal. On the other hand, the droplet jet heads 2 are replaced (ST9) if the droplets are not ejected normally even after executing the predetermined number of sessions of the checking operation (YES in ST7). Then, the checking operation as to whether or not the droplets are properly ejected is executed again after replacing the droplet jet heads 2.

As described above, the droplet jet heads are caused to scan over the regions where the droplets are jetted without jetting additional droplets in the operation for checking the coated state prior to entering the process to apply the droplets on the substrate, and presence of the deposits attached to the nozzles is detected based on changes in the shapes of the droplets thereafter. In this way, it is possible to provide the droplet jetting applicator and the method of manufacturing a coated body, which are capable of detecting deposits that are attached to the nozzles easily and reliably without changing the originally applied configuration.

This invention is not limited to the above-described embodiment. The present invention can also be implemented by modifying the constituents without departing from the scope of the invention. Moreover, other aspects of the present invention can be achieved by appropriately combining the constituents that are disclosed in the above-described embodiment. For example, several constituents can be eliminated from all the constituents of the embodiment. Further, it is also possible to combine the constituents that are disclosed in different embodiments as appropriate.

What is claimed is:

1. A droplet jetting applicator comprising:

a droplet jet head being movably provided and having a nozzle surface provided with a plurality of nozzles, the droplet jet head being configured to jet a liquid as a plurality of droplets respectively from the plurality of nozzles to an object to be coated, each of the droplets on the object having a predetermined shape, the object including a functional region subjected to ejection of the thus formed droplets from the droplet jet head in a predetermined pattern and a check region provided in a region other than the functional region;

a cleaner configured to clean the nozzle surface;

an image shooting unit configured to shoot shapes of the droplets on the object jetted by the droplet jet head; and a controller configured to control the droplet jet head, the cleaner and the image shooting unit, and to detect the shapes of the droplets on the object shot by the image shooting unit, wherein the controller is configured to control a preparation process which prepares coating the object and a coating process which is configured to jet the droplets to the functional region, and the preparation process comprises jetting the droplets from the nozzles onto the check region while moving the droplet jet head thus forming the droplets on the check region;

causing the droplet jet head to scan the droplets on the check region without jetting additional droplets;

shooting the check region by using the image shooting unit;

detecting shapes of the droplets on the check region shot by the image shooting unit and comparing each of the shapes of the droplets on the check region with the predetermined shape;

cleaning the droplet jet head by use of the cleaner after comparing each of the shapes of the droplets on the check region when the controller judges that a foreign material is deposited on the droplet jet head on the basis of each of the shapes of the droplets on the check region as a result of the comparison; and replacing the droplet jet head after comparing each of the shapes of the droplets on the check region when the controller judges that the foreign material is deposited on the droplet jet head even after the droplet jet head is cleaned by use of the cleaner, on the basis of each of the shapes of the droplets on the check region as a result of the comparison.

* * * * *